US006863628B1

(12) United States Patent
Brandt

(10) Patent No.: US 6,863,628 B1
(45) Date of Patent: Mar. 8, 2005

(54) VIBRATION DAMPING STRIKING IMPLEMENT

(76) Inventor: Richard A. Brandt, 69 Fifth Ave., Apt. 16A, New York, NY (US) 10003

( * ) Notice: Subject to any disclaimer, the term of this patent is extended or adjusted under 35 U.S.C. 154(b) by 0 days.

(21) Appl. No.: 09/528,560

(22) Filed: Mar. 20, 2000

(51) Int. Cl.[7] ..... A63B 59/06
(52) U.S. Cl. ..... 473/520; 473/566; 473/310
(58) Field of Search ..... 473/564–568, 473/457, 519, 520, 310

(56) References Cited

U.S. PATENT DOCUMENTS 1,121,189 A * 12/1914 Lincoln ..... 473/564
3,861,682 A 1/1975 Fuji
3,877,698 A * 4/1975 Volpe ..... 473/520
3,963,239 A 6/1976 Fuji
4,951,948 A * 8/1990 Peng ..... 473/520
5,219,164 A * 6/1993 Peng ..... 473/520
5,524,884 A * 6/1996 Haines ..... 473/520
5,593,158 A 1/1997 Filice
5,865,694 A * 2/1999 Duong-Van ..... 473/520
6,050,908 A * 4/2000 Muhlhausen ..... 473/520
6,432,006 B1 * 8/2002 Tribble ..... 473/564

* cited by examiner

*Primary Examiner*—Mark S. Graham
(74) *Attorney, Agent, or Firm*—Schiff Hardin LLP

(57) ABSTRACT

A shock absorbing striking implement comprises a barrel and a handle. The barrel component comprises a distal end and a proximal end. The proximal end of the barrel tapers into a thin rod. The handle component is hollow with a proximal end and an outward tapered distal end. The tapered proximal end of the barrel component is inserted into the outward tapered distal end of the handle component. An elastomeric material is inserted in the region between the proximal end of the barrel component which is inserted within the distal end of the handle component, and the distal end of the handle component. The elastomeric material is selected with a modulus of elasticity and damping factor such that the vibrations of the tapered proximal end of the barrel embedded in the elastomeric material induced by the transverse waves that propagate through the striking implement are largely adsorbed by the material.

10 Claims, 8 Drawing Sheets

CONVENTIONAL BAT
BAT
HANDLE
BARREL
HANDLE
BARREL

VIBRATION DAMPING STRIKING IMPLEMENT

FIELD OF THE INVENTION

The present invention relates generally to sports in which a striking implement is used, such as a baseball bat, golf club or tennis racket. Specifically, the invention relates to a striking implement for sports, which provides enhanced vibration damping in its handle.

BACKGROUND OF THE INVENTION

Many sports require the use of a striking implement. These include, but are not limited to baseball and softball bats (collectively "ball bats"), golf clubs, and tennis rackets. The sporting industry has engaged in much research and development to improve upon the design of the striking implement to enhance performance during play. One area of interest has been shock absorption, or transverse wave attenuation. Often, when the striking implement strikes an object, such as a ball, transverse waves propagate through the striking implement, from the point of impact, through the handle and to the hands and arms of the player holding the striking implement. As a result the player experiences a noticeable discomfort, commonly referred to as shock. In young or inexperienced players the desire to avoid shock may effect their confidence in their skill. It may even effect their performance.

U.S. Pat. No. 5,593,158 to Filice, relates to a shock attenuating hollow ball bat comprising two distinct components: a barrel and a handle. The barrel is open at a proximal tapered end for receiving the distal end of the handle. An elastomeric material is interposed between the handle and barrel at their union. As the '158 patent states, by isolating the handle from the barrel and allowing relative movement of these two components, propagation of the transverse waves to the handle and to the player is reduced.

U.S. Pat. No. 4,951,948 to Peng also relates to a Shock Absorbing Bat. This ball bat comprises a hollow barrel and a handle. The handle extends into the hollow barrel and is secured to the top of the inside of the barrel by means of a spring. A retaining collar and elastic ring are also used to hold the barrel and handle together firmly in place.

SUMMARY OF THE INVENTION

It is an object of the present invention to provide a novel design for a striking implement, which attenuates transverse waves in the striking implement so as to eliminate them, or reduce their strength so as to minimize any discomfort to the player, before the transverse waves reach the player handling the striking implement.

It is a further object of the present invention to provide a design for a striking implement with improved vibratory attenuation as compared with prior art designs.

It is a further object of the present invention to provide a novel design for a ball bat with improved vibration attenuation, as compared with the prior art, so as to attenuate or eliminate transverse waves in the ball bat before being propagated to the player handling the ball bat.

Accordingly, the present invention relates to a striking implement comprising a barrel and a handle. The barrel component comprises a distal end and a proximal tapered end. In contrast to prior art barrels, the barrel of the striking implement of the present invention tapers at the proximal end into a thin stem. The handle component is hollow with a proximal end and an outward tapered distal end. In contrast to prior art designs the tapered proximal end of the barrel component is inserted into the outward tapered distal end of the handle component. An elastomeric material is inserted between the proximal end of the barrel component and the distal end of the handle component at the union of these two components.

The elastomeric material is selected with a modulus of elasticity (elastic characterization) and a damping loss factor (viscous characterization) so as to maximize the absorption of the transverse vibrations by the elastomeric material. The transverse vibrations arise from the impact of the barrel with a ball and travel from the impact point on the barrel down to the handle. In this manner the transverse waves are not noticeably transferred to the handle, or player.

DETAILED DESCRIPTION OF THE INVENTION

The vibrational damping striking implement of the present invention will be described in the context of a preferred embodiment, namely a ball bat. The novel aspects of the ball bat described herein are applicable to other sport striking implements such as golf clubs and tennis rackets. Accordingly, all such sports striking implements incorporating the novel elements of the present invention are considered as within the scope of the present invention.

When a player strikes a ball with a ball bat, transverse waves typically propagate through the barrel of the ball bat, to the handle and are felt by the player gripping the handle of the ball bat. The transverse waves result from the impact between the ball and ball bat. For conventional aluminum softball bats, the range in frequencies is typically from 150 Hz to 250 Hz. The effect of transverse waves propagating through a ball bat is well known and from the common experience of players, is uncomfortable. The level of discomfort is a matter of degree, relating to the amplitude and frequency of the propagating waves. The striking implement of the present invention is designed to provide a novel design in which such transverse waves are attenuated before reaching the player. In this way the player does not feel the "shock". Alternatively, the shock felt by the player is accompanied with little or no discomfort.

Figure 1A:
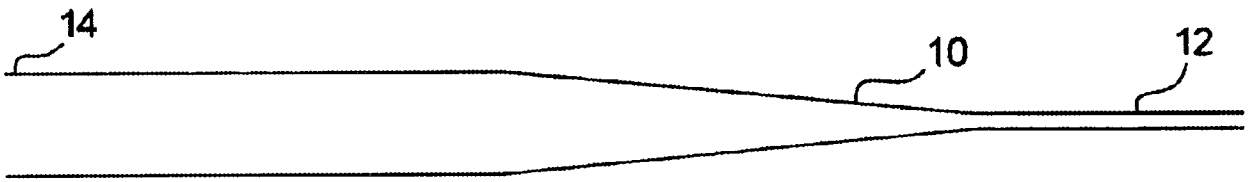
FIG. 1A illustrates the barrel component of one embodiment of the striking implement of the present invention, a ball bat.
Figure 1B:
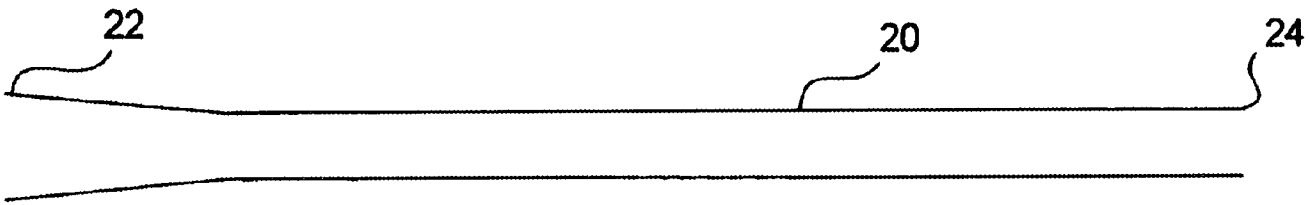
FIG. 1B illustrates the handle component of the same embodiment of the present invention as shown in FIG. 1A.
Figure 2:
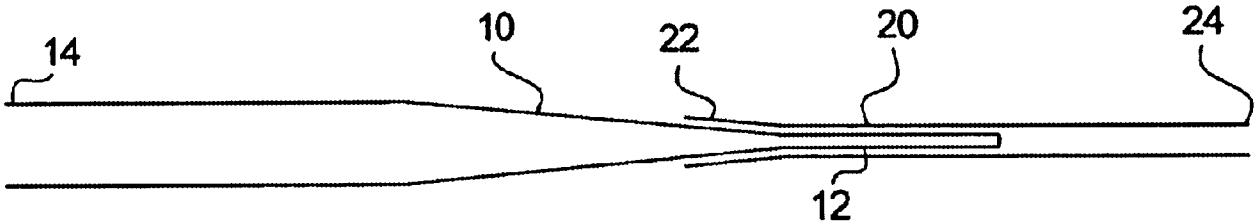
FIG. 2 illustrates the manner in which the barrel component is inserted into the handle component of the ball bat of the present invention.

Referring to FIGS. 1A, 1B and 2 the three principal components of the ball bat and their relation when assembled are shown. Barrel 10 is shown in FIG. 1A. The barrel comprises the section of the ball bat that will come into contact with the ball. At one end (proximal end) of barrel component 10, a thin stem 12 is formed by tapering the end of the barrel component 10. At the other end 14 of barrel 10 (distal end) conventional end caps (not shown) may be used.

In one preferred embodiment of the present invention stem 12 has a rod-like shape. More specifically, one particularly advantageous embodiment of stem 12 is a rod approximately 8 inches long with an outside diameter of ⅜ of an inch. As described below, the purpose of this design of barrel 10 is so that it may be inserted within handle 20, as shown in FIG. 2. Clearly, other shapes for projection 12 that allow for the assembly of the ball bat as described herein, are within the scope of the present invention.

Referring to FIG. 1B, the second principal component is shown, namely handle 20. Handle 20 has an outward taper to its distal end 22 for receiving stem 12 of barrel 10. In other respects the handle 20 is a conventional hollow ball bat handle. Typically, such a ball bat handle will have an outer diameter of approximately 0.82 inches and a wall thickness of approximately 0.08 inches. Since the ball bat of the present invention has an elastomeric material between the inside of the handle and the stem of the barrel component, it is sufficient to have a wall thickness of approximately 0.04 inches. Furthermore, proximal end 24 can be capped with a conventional end cap as is typical with ball bats.

Figure 3:
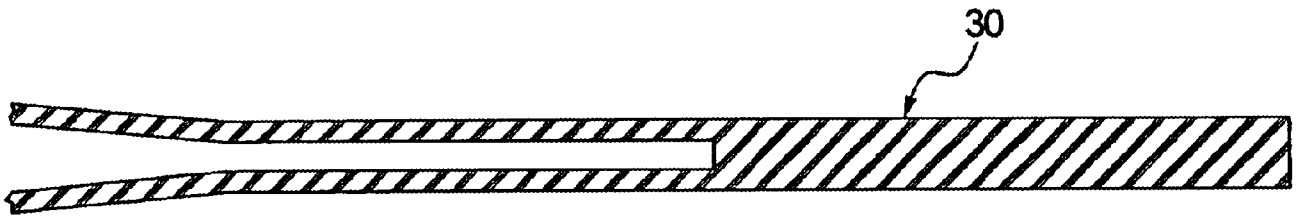
FIG. 3 illustrates the use of the elastomeric material between the barrel and handle components in accordance with the present invention.

Referring to FIG. 3, with the stem 12 of barrel 10 inserted into the distal tapered end of handle 20, an elastomeric material 30 is inserted within the space between the barrel 10 and handle 20. The elastomeric material 30 may be either molded to fill the space, or poured into the space and let to set with the stem 12 of barrel 10 in the hollow space of handle 20. Whether the elastomeric material fills up the entire space below the stem of the barrel component, as shown in FIG. 3 is merely a design choice. In accordance with the principles of the bat ball of the present invention it is not necessary that the elastomeric material fill up the entire space of the inside of the bat ball handle.

The elastomeric material is selected with a modulus of elasticity (elastic characterization defined as the ratio of stress to strain) and a damping loss factor (viscous characterization defined as the ratio of actual absorbed energy to maximum possible absorbed energy) so as to maximize the absorption of the transverse vibrations by the elastomeric material. The absorbed energy will typically be converted into heat. Thus the transverse waves are not noticeably transferred to the handle, or player.

To maximize absorption of the transverse waves, the selected elastomeric material placed between the stem 12 and the handle 20 must have high damping and energy absorption characteristics at the typical frequencies found for transverse vibrations in ball bats. As stated above this typically falls within the range of 150–250 Hz. The shock producing vibrations will thus be largely dissipated as heat and not transmitted to the hands of the player.

One preferred embodiment of the present invention utilizes an elastomeric material that is highly damped and visco-elastic. This material is commercially known as Sorbothane®. Fifty durometer Sorbothane® has a damping loss factor of 0.75 at a frequency of 200 Hz and at a temperature of 20° C. When this material was used as the elastomer in a prototype softball bat constructed in accordance with the present invention, the amplitude of the 200 Hz transverse vibrations in the ball bat barrel were reduced in the ball bat handle by a factor of ten after 40 ms. In a conventional ball bat handle, there is essentially no reduction of the amplitude of these vibrations within this time period.

To further enhance transverse wave absorption, rod-like stem 12 can be designed with a length l and diameter d so that the transverse waves that propagate to the stem vibrate at a frequency that matches the optimal absorption frequency of the elastomeric material. Specifically, the frequency of the vibrating stem 12 is proportional to $d/l^2$. In one preferred embodiment of the present invention the stem 12 is designed as a rod with a length of 10 inches and a diameter of 0.625 inches.

These as well as other reasons explain the significant differences in damping effectiveness of a ball bat of the present invention as compared with conventional ball bats that attempt to dampen vibrations by inserting the handle into the barrel. Other reasons include the amplitude of the vibrations of stem 12 will be naturally much less than the amplitude of the barrel vibrations because the stem is stiffer and thicker. In addition, the centripetal force on the ball bat caused by the ball bat swing tends to pull the stem 12 away form the handle 20, thus increasing the isolation of the handle 20 from the barrel 10. Exactly the opposite occurs in the ball bats of conventional construction, where this force tends to pull the barrel and handle together. Furthermore, since elastomer 30 and handle 20 are situated far from the impact point on the barrel 10 the mechanism of the present invention, i.e. the stem handle elastomer assembly will not effect the performance of the ball bat. In contrast, the damping mechanism in conventional ball bats is located much closer to the point of impact between ball and ball bat.

The design of the present invention to dampen the transverse waves does not preempt the application of other known techniques to enhance the performance of the striking implement. Thus for example, known criteria for enhancing the performance of a ball bat can be applied. This includes for example, the use of end loads for added impact to the ball leaving the ball bat, and a selection of wall thickness and materials. Furthermore, since transverse waves vibrate at approximately 200 Hz while performance enhancing waves vibrate at about 500 Hz, the mechanism of the present invention should not have an adverse impact on ball bats designed for performance enhancement. See U.S. patent Ser. No. 08/990,294, filed on Dec. 15, 1997 and entitled "Striking Implement".

When assembling the striking implement of the present invention, it is necessary to anchor the barrel 10 to handle 20. Any means known to one of ordinary skill in the art can be effective in anchoring these two components. Referring to FIGS. 4A–4E, five different embodiments are shown for anchoring barrel 10 to handle 20. These embodiments are selected for illustration purposes only, not to imply any limitation on the anchoring means that may be employed.

Figure 4A:
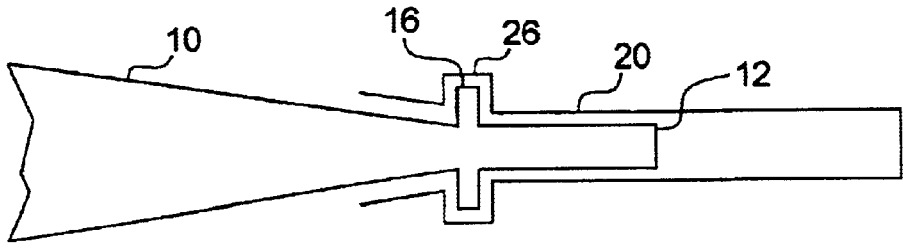
FIG. 4A illustrates one design for anchoring the barrel within the elastomeric material in accordance with the present invention.

Referring to FIG. 4A, the anchor means includes a projection 16, which extends outward from the stem 12, in a direction generally perpendicular to the stem 12. Projection 16 is received by a receiving projection 26. Projection 26 extends outward from the outer surface wall of handle 20 and forms a ledge within the inner surface wall of handle 20 for receiving projection 16. As is clearly visible from FIG. 4A the interaction of projections 16 and 26 anchor barrel 10 to handle 20.

Figure 4B:
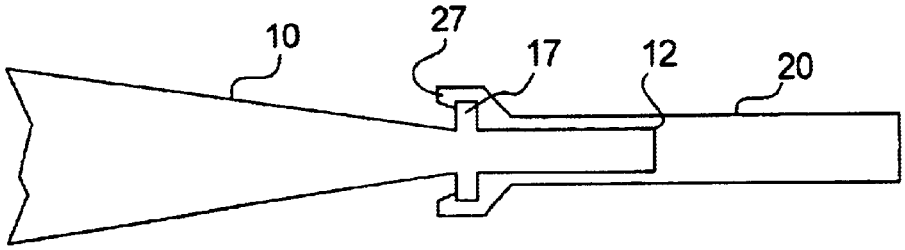
FIG. 4B illustrates a second design for anchoring the barrel within the elastomeric material in accordance with the present invention.

Referring to FIG. 4B, a second anchor means is illustrated where projection 12 has a lateral projection 17 similar to that shown in FIG. 4A. However instead of forming a ledge for receiving projection 17, the edge of the distal end of handle 20 is formed with a lip 27. Lip 27 loops over and inward to prevent barrel 10 from being pulled out from hollow handle 20. Obviously the elastomeric material 30, which fills in the space between barrel 10 and handle 20 prevents movement in all other directions.

Figure 4C:
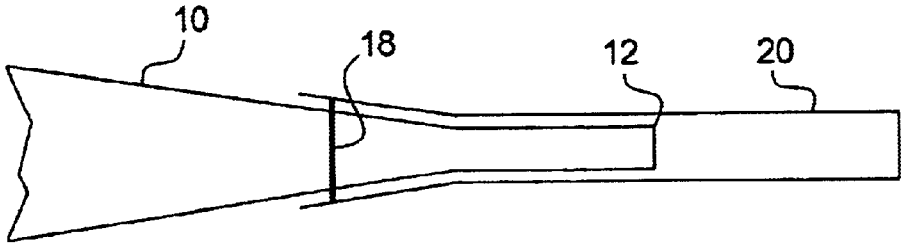
FIG. 4C illustrates a third design for anchoring the barrel within the elastomeric material in accordance with the present invention.
Figure 4D:
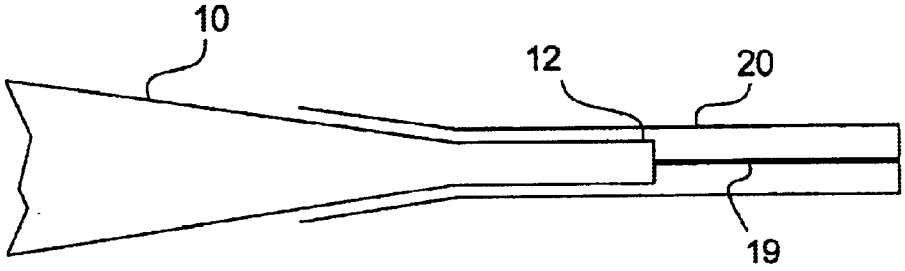
FIG. 4D illustrates a fourth design for anchoring the barrel within the elastomeric material in accordance with the present invention.
Figure 4E:
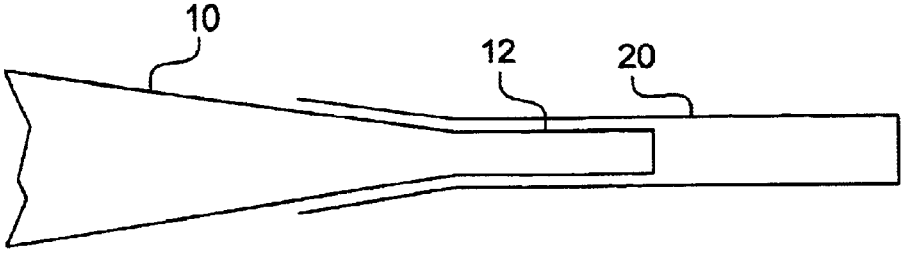
FIG. 4E illustrates a fifth design for anchoring the barrel within the elastomeric material in accordance with the present invention.

Referring to FIGS. 4C and 4D, the projections of the first two anchor embodiments are replaced with a tie rod 18. Tie rod 18 anchors barrel 10 to handle 20 by securing at least one end to the inner wall of handle 20. The other end of tie rod may be secured to the stem 12 of barrel 10. As shown in FIG. 4D, a tie rod 19 is used by securing one end to the inner floor of handle 20 and the other end to the edge of projection 12. Alternatively, tie rod 18 may pass through stem 12 or be otherwise secured to stem 12 somewhere along the length of the tie rod 18.

Lastly, the hollow of handle 20 below projection 12 may be filled either with the elastomeric material 30, or some other material. In this embodiment, projection 12 may be directly secured to the filler material, as shown.

Figure 5A:
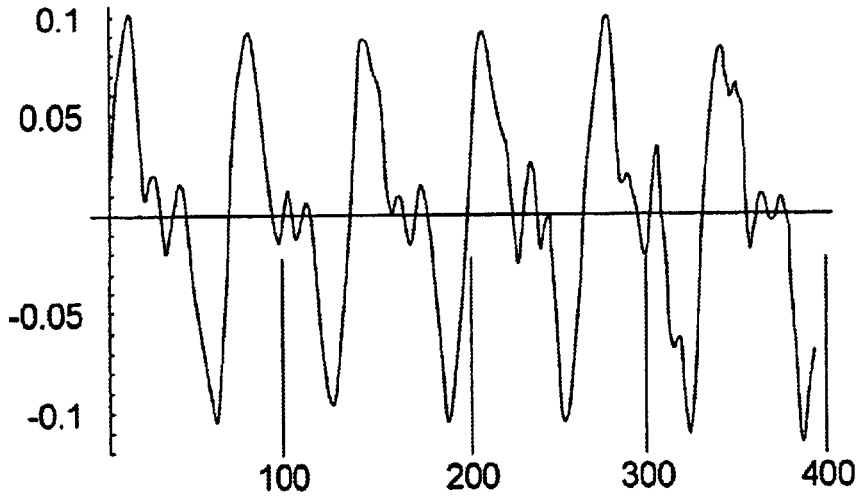
FIG. 5A is a computer-generated amplitude versus time graph of the transverse vibrations found in the barrel of a conventional ball bat.
Figure 5B:
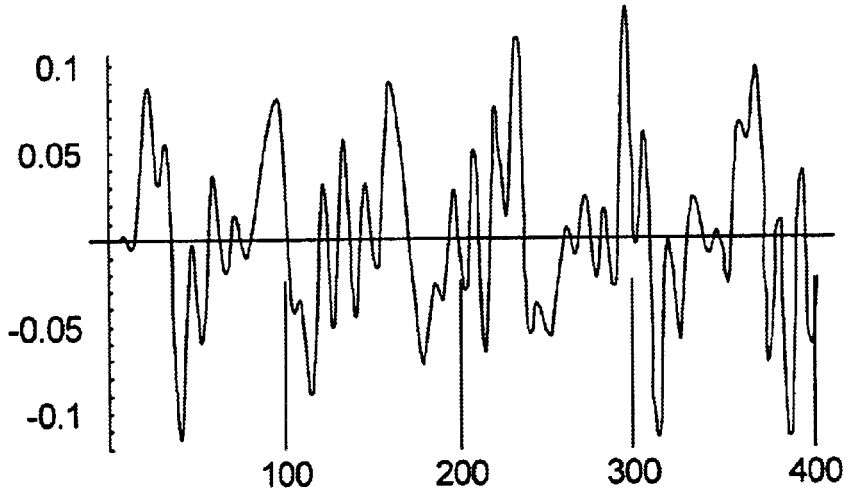
FIG. 5B is a computer-generated amplitude versus time graph of the transverse vibrations found in the handle of a conventional ball bat.
Figure 5C:
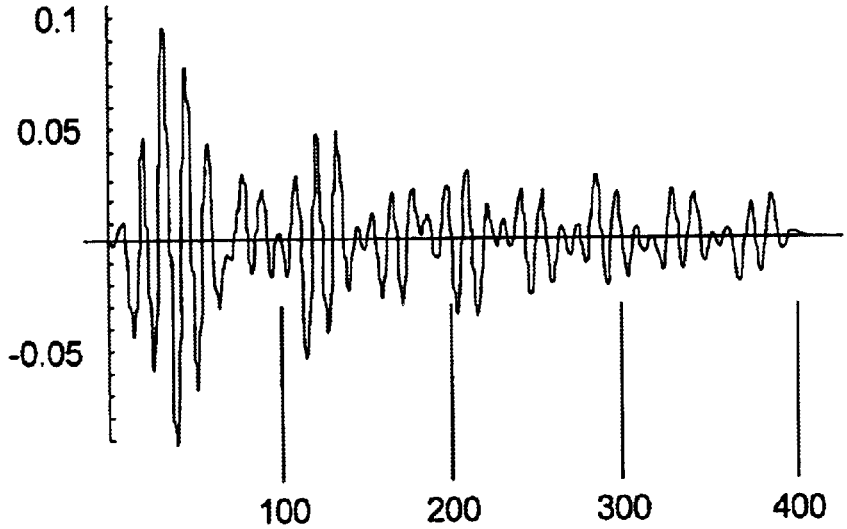
FIG. 5C is a computer generated amplitude versus time graph of the transverse vibrations found in the handle of a ball bat designed in accordance with the present invention.

Referring to FIGS. 5A–5C, the graphs illustrate the enhanced effect of a ball bat designed in accordance with the present invention as compared with that of a conventional ball bat. The conventional ball bat used for these graphs had not been designed with any enhancements for damping vibrations. However, results similar to those of the conventional ball bats (not shown) have been observed even with prior art ball bats claiming to dampen vibrations.

All three graphs represent amplitude of transverse waves shown on the vertical axis and the first 0.05 seconds after impact between the ball bat and ball, shown on the horizontal axis. It should be noted that typically the transverse waves would propagate down to the player's hands after about 2–3 milliseconds. FIG. 5A represents the transverse waves propagating through the barrel of a conventional ball bat. Clearly, no significant damping has occurred during the first 0.05 seconds after impact. In contrast, FIG. 5B shows the transverse waves propagating through the handle of a conventional ball bat. FIG. 5C shows the transverse waves propagating through the handle of a ball bat of the present invention. It is clear upon comparison of these graphs that over a time period of 40 milliseconds the amplitude of the transverse waves in the ball bat designed in accordance with the present invention, decreased by over a factor of ten.

Referring to FIGS. 6A through 6J a series of graphs are presented showing the development of the transverse wave over time in both the barrel and handle of a conventional ball bat and a ball bat designed in accordance with the present invention. The left curve of each graph represents the wave on a conventional ball bat, while the right curve represents the wave on a ball bat designed in accordance with the represent invention. For each curve of each ball bat, the left portion of the curve represents the transverse wave in the handle of the ball bat. The right portion of the curve represents the transverse wave in the barrel of the ball bat.

Proceeding from FIG. 6A to FIG. 6J, each figure represents the transverse wave at a different time instant, starting with the impact and increasing in 1 millisecond increments, up to 9 milliseconds after impact.

Figures 6A, 6B, 6C, 6D, 6E, 6F, 6G, 6H, 6I, 6J:
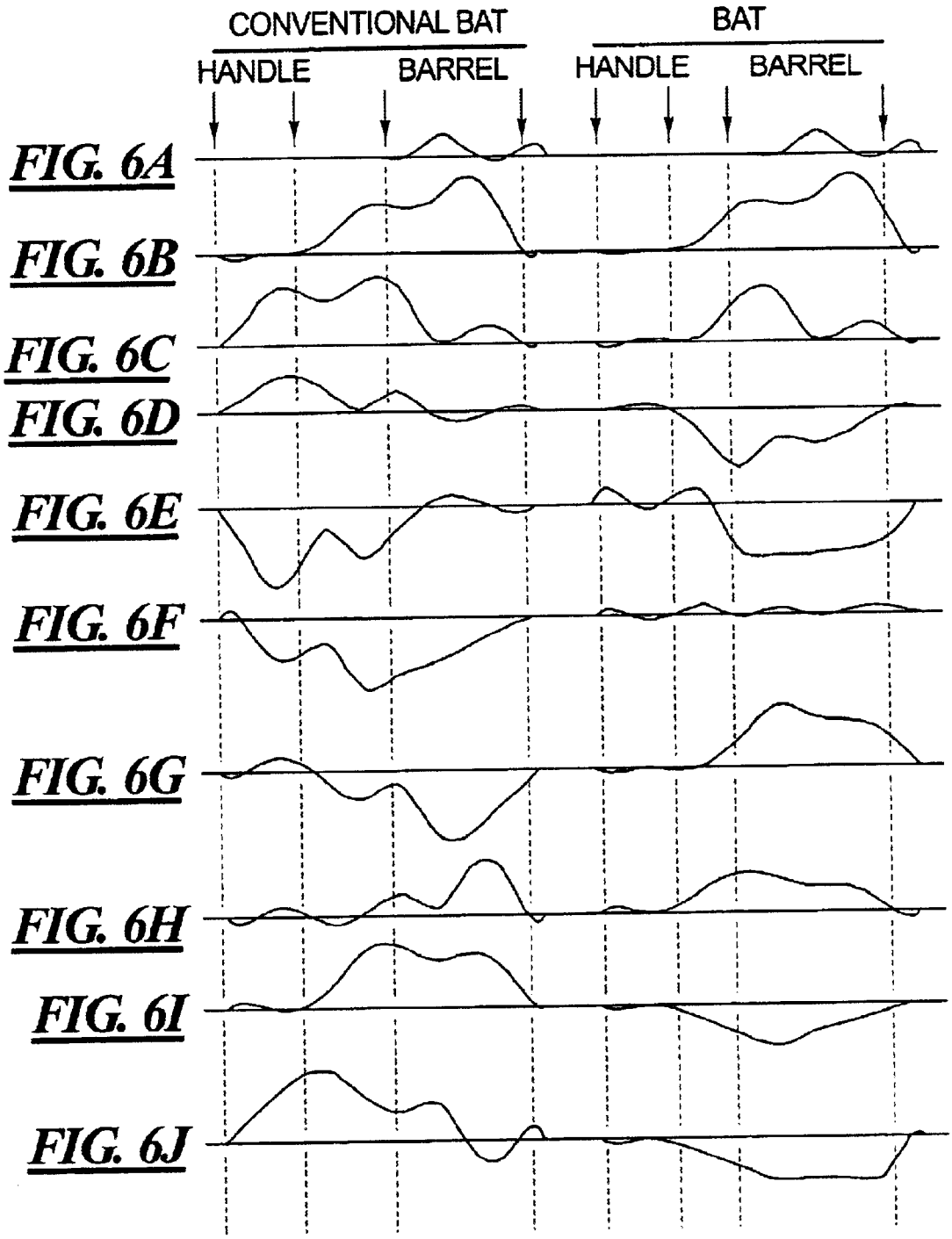
FIG. 6A depicts the transverse waves in a ball bat handle and ball bat barrel at impact between ball and ball bat and compares the waves for a conventional ball bat with the waves for a ball bat in accordance with the present invention.
FIG. 6B depicts the transverse waves in a ball bat handle and ball bat barrel 1 ms after impact between ball and ball bat and compares the waves for a conventional ball bat with the waves for a ball bat in accordance with the present invention.
FIG. 6C depicts the transverse waves in a ball bat handle and ball bat barrel 2 ms after impact between ball and ball bat and compares the waves for a conventional ball bat with the waves for a ball bat in accordance with the present invention.
FIG. 6D depicts the transverse waves in a ball bat handle and ball bat barrel 3 ms after impact between ball and ball bat and compares the waves for a conventional ball bat with the waves for a ball bat in accordance with the present invention.
FIG. 6E depicts the transverse waves in a ball bat handle and ball bat barrel 4 ms after impact between ball and ball bat and compares the waves for a conventional ball bat with the waves for a ball bat in accordance with the present invention.
FIG. 6F depicts the transverse waves in a ball bat handle and ball bat barrel 5 ms after impact between ball and ball bat and compares the waves for a conventional ball bat with the waves for a ball bat in accordance with the present invention.
FIG. 6G depicts the transverse waves in a ball bat handle and ball bat barrel 6 ms after impact between ball and ball bat and compares the waves for a conventional ball bat with the waves for a ball bat in accordance with the present invention.
FIG. 6H depicts the transverse waves in a ball bat handle and ball bat barrel 7 ms after impact between ball and ball bat and compares the waves for a conventional ball bat with the waves for a ball bat in accordance with the present invention.
FIG. 6I depicts the transverse waves in a ball bat handle and ball bat barrel 8 ms after impact between ball and ball bat and compares the waves for a conventional ball bat with the waves for a ball bat in accordance with the present invention.
FIG. 6J depicts the transverse waves in a ball bat handle and ball bat barrel 9 ms after impact between ball and ball bat and compares the waves for a conventional ball bat with the waves for a ball bat in accordance with the present invention.

Referring to FIGS. 6A and 6B it is clear that for the first 1 ms after impact the transverse waves have not reached the handle of either the conventional ball bat or the ball bat of the present invention. However, beginning with FIG. 6C (2 ms after impact) the amplitudes of the vibrations on the conventional ball bat handle is large. In contrast, the amplitude of the transverse wave on the ball bat of the present invention is small. This difference continues through FIG. 6J.

Figure 7A:
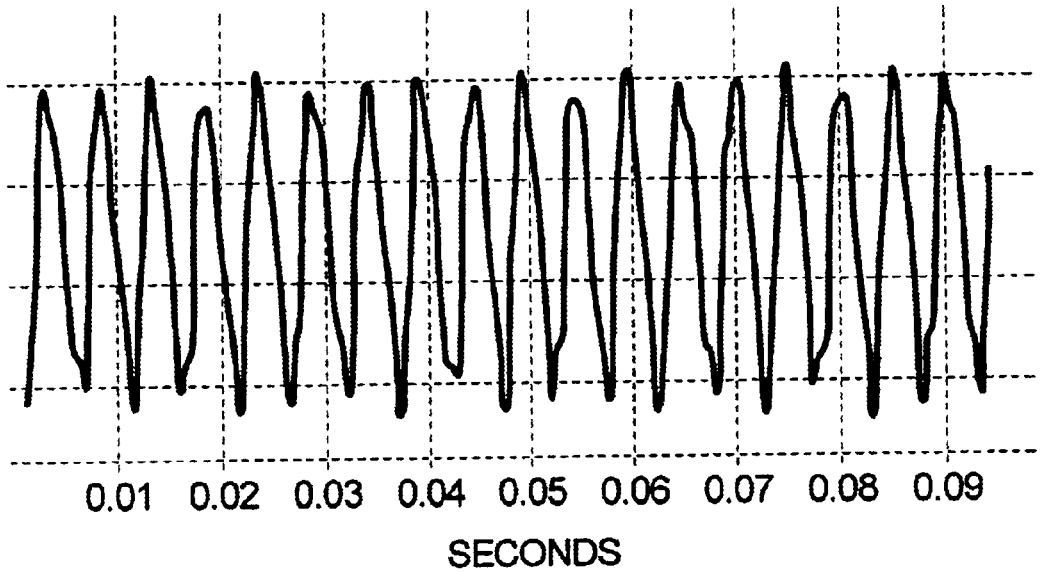
FIG. 7A represents actual measurements captured from an oscilloscope of the vibrations propagating through the handle of a conventional ball bat over 0.1 seconds.
Figure 7B:
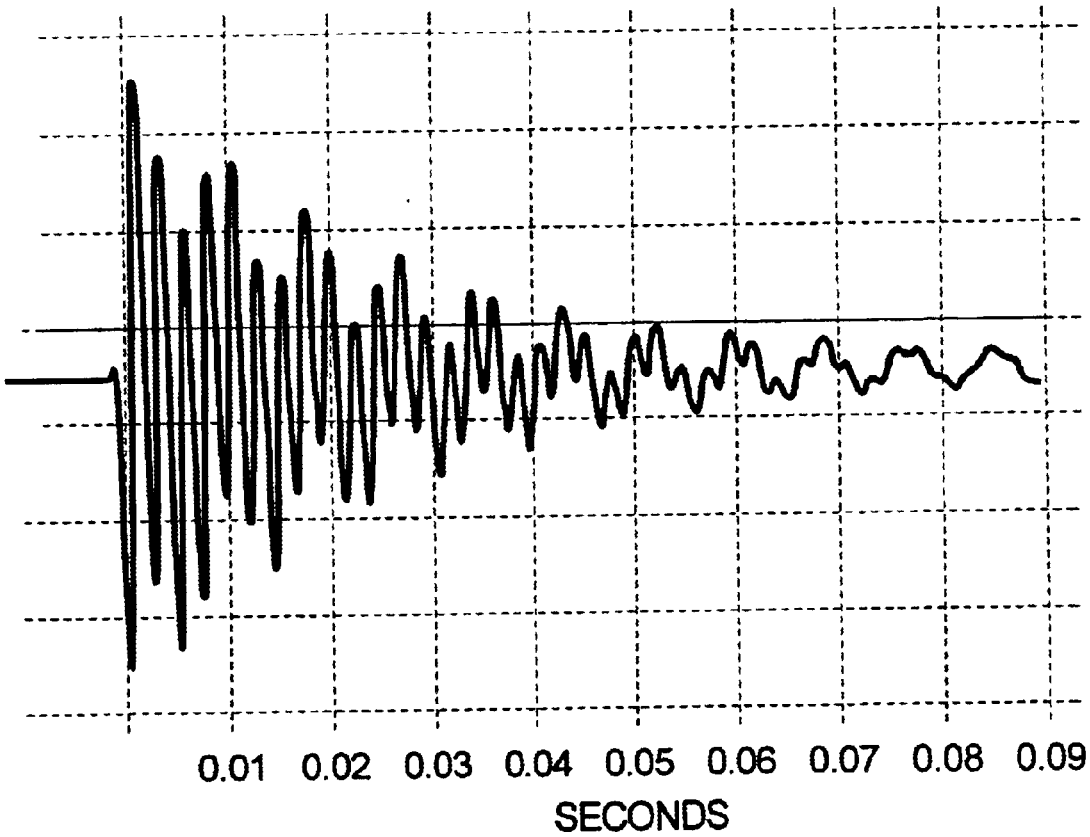
FIG. 7B represents actual measurements captured from an oscilloscope of the vibrations propagating through the handle of a ball bat designed in accordance with the present invention over 0.1 seconds.

Referring to FIGS. 7A and 7B, actual oscilloscope displays are shown for the vibrations on a conventional ball bat and the ball bat of the present invention, respectively. For both graphs the vibrations were measured on the ball bat handles. It is interesting to note that the vibrations on the conventional ball bat are at 200 Hz and experience no damping over 0.1 seconds. In contrast, the transverse waves on the ball bat of the present invention vibrate at 400 Hz and 100 Hz. The high frequency waves dampen by a factor of 30 over 0.1 seconds and the low frequency waves dampen by a factor of 14 over 0.1 seconds.

Figure 8A:
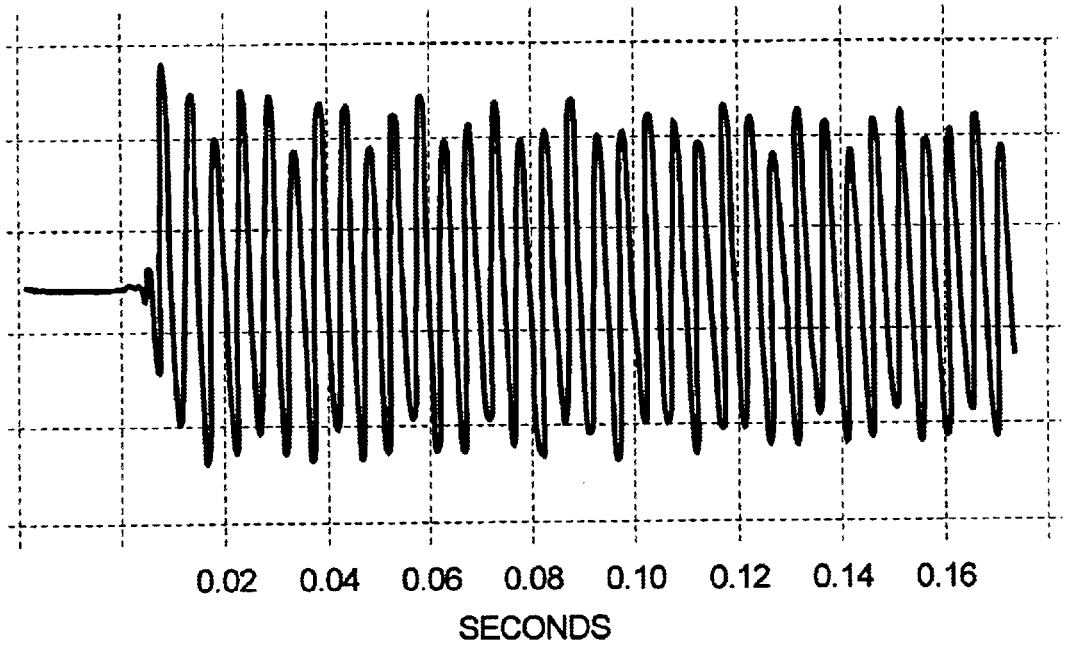
FIG. 8A represents actual measurements captured from an oscilloscope of the vibrations propagating through a conventional ball bat handle over 0.18 seconds.
Figure 8B:
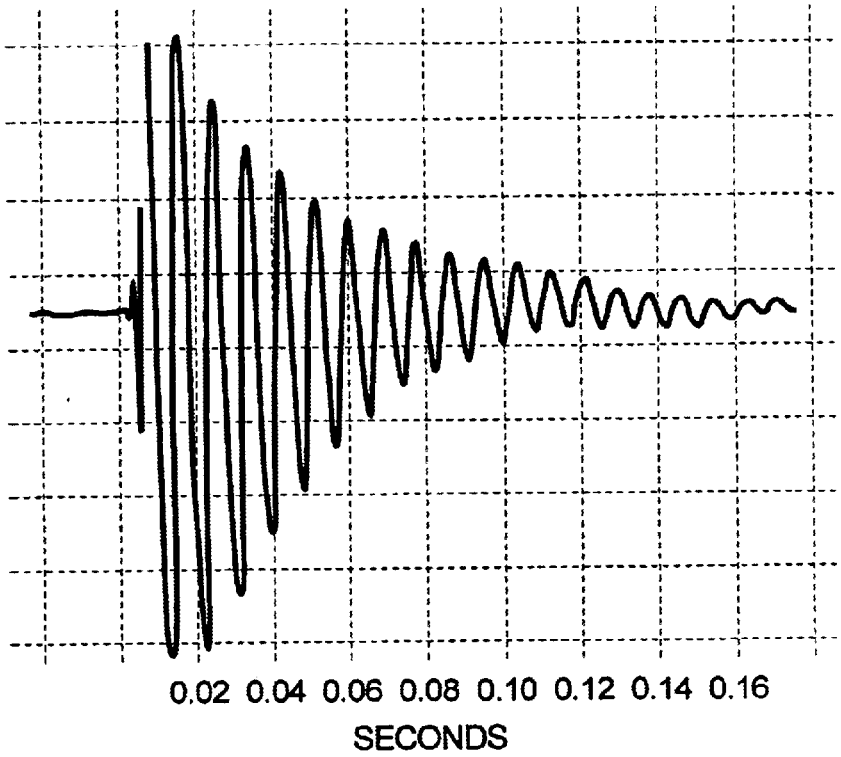
FIG. 8B represents actual measurements captured form an oscilloscope of the vibrations propagation through the handle of a ball bat designed in accordance with the present invention over 0.18 seconds.

Referring to FIGS. 8A and 8B the transverse waves from FIGS. 7A and 7B are now shown over a duration of 0.18 seconds. While there has not been significant damping of vibrations in the handle of the conventional ball bat, as shown in FIG. 8A, the 100 Hz waves on the handle of the ball bat of the present invention have decreased by a factor of 30. The high frequency waves are not shown in FIG. 8B.

Figure 8C:
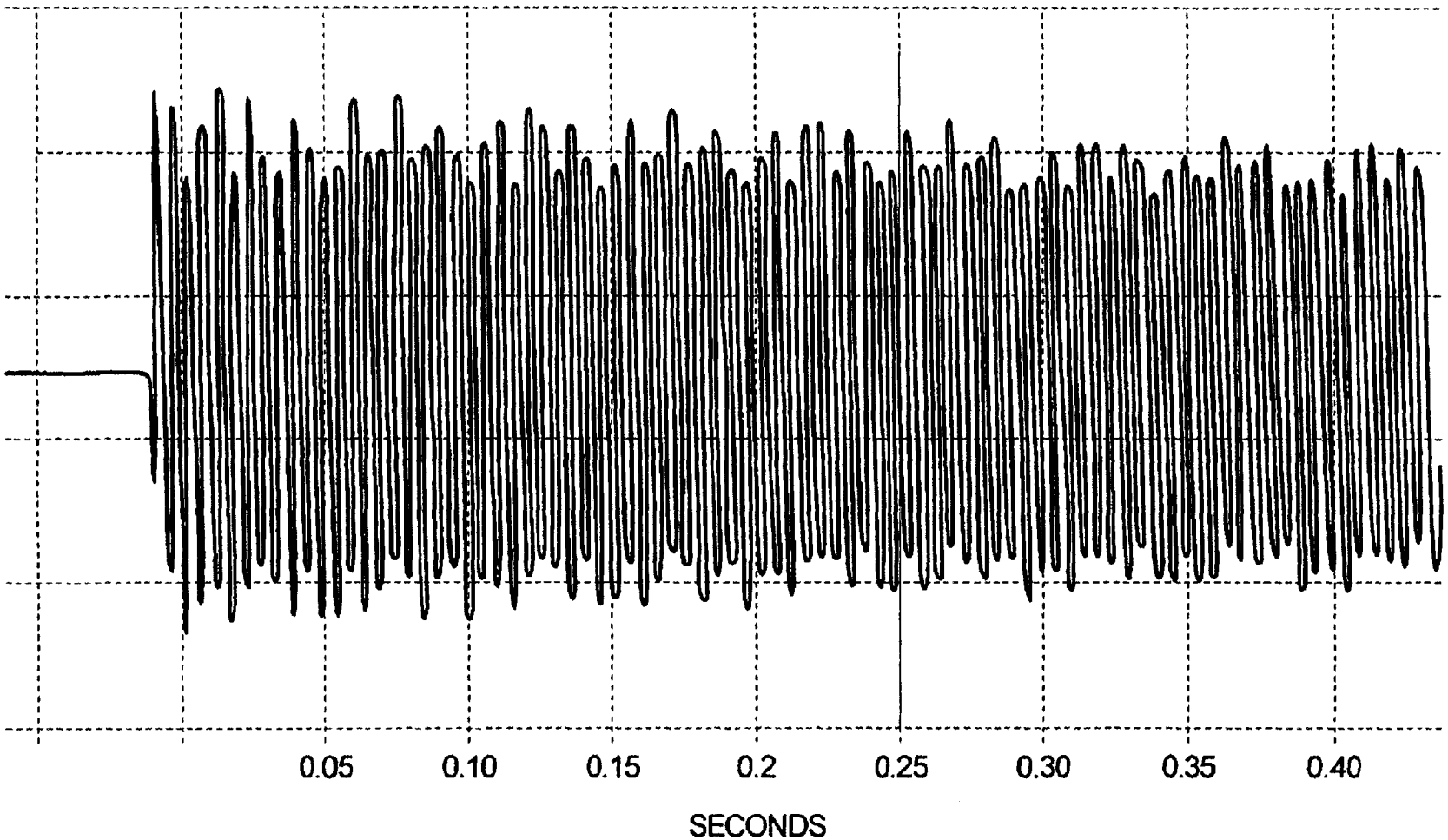
FIG. 8C represents actual measurements captured from an oscilloscope of the vibrations propagating through a conventional ball bat handle over 0.45 seconds.
Figure 8D:
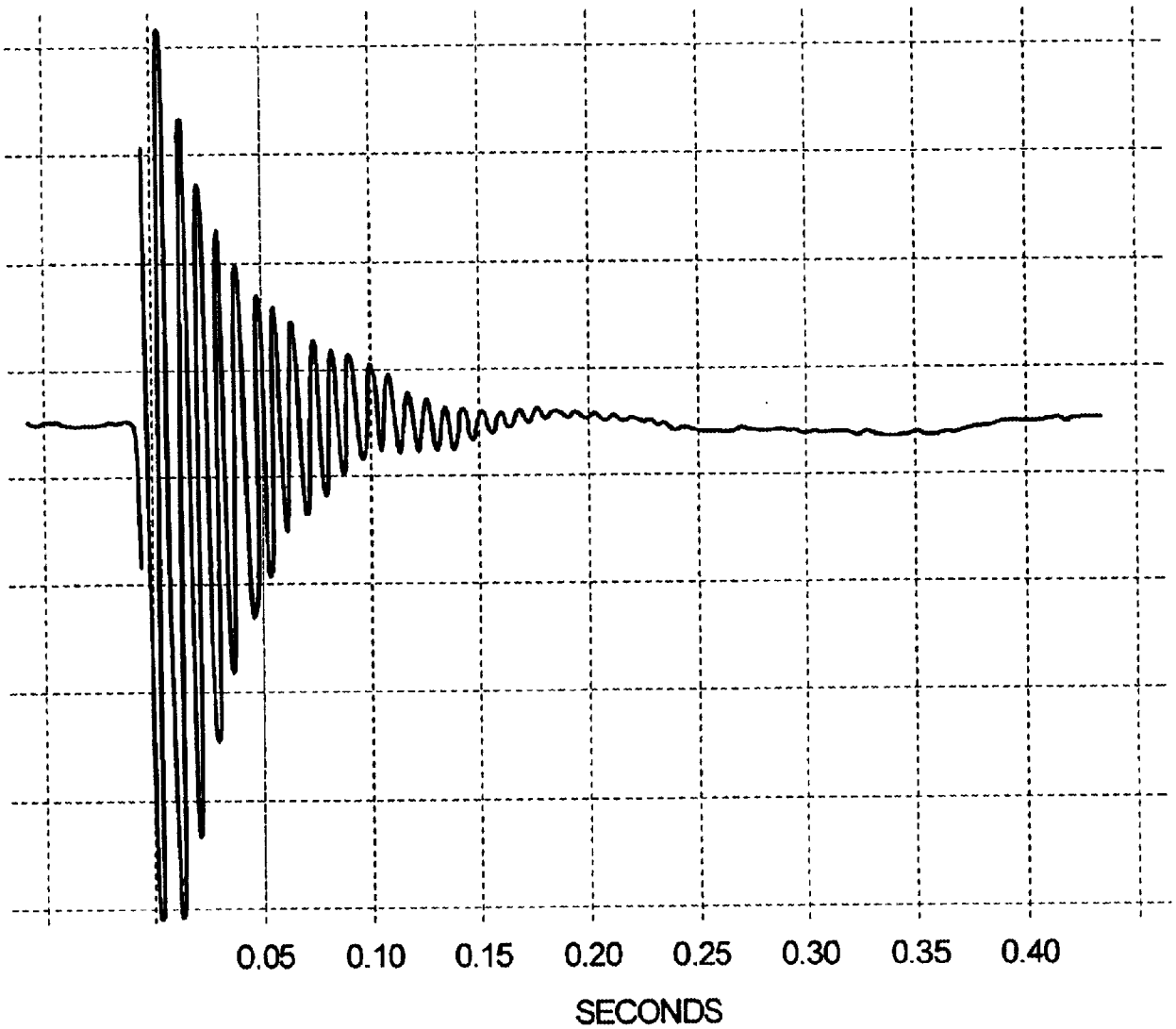
FIG. 8D represents actual measurements captured form an oscilloscope of the vibrations propagation through the handle of a ball bat designed in accordance with the present invention over 0.45 seconds.

Referring to FIGS. 8C and 8D, the transverse waves are now shown over a duration of 0.45 seconds. Again, there is no significant damping of waves in the handle of the conventional ball bat. However, the low frequency vibrations in the ball bat of the present invention have decreased by a factor of 100 over 0.25 seconds.

The foregoing merely illustrates the principles of the present invention. Those skilled in the art will be able to devise various modifications, which although not explicitly described or shown herein, embody the principles of the invention and are thus within its spirit and scope.

What is claimed is:

1. A striking implement for attenuating transverse shock waves propagating through said striking implement, comprising:

a hollow barrel component having a distal end and a proximal end, said proximal end tapered to a thin projection, a hollow handle component having a proximal end and a distal end, an outer surface wall and an inner surface wall, an outer floor surface and an inner floor surface, said distal end tapered outward so as to receive said proximal end of said barrel; and an elastomeric material for inserting between said proximal end of said barrel component and said distal end of said handle component;

wherein said elastomeric material has a modulus of elasticity and damping factor such that the amplitude of the vibrations of said handle arising from the impact of a ball with the striking implement are reduced by at least 80% within about 0.1 seconds from the time when the vibrations first arise on the handle.

2. The striking implement of claim 1 further comprising an anchor for securing said barrel within said elastomeric material and said hollow handle component.

3. The striking implement of claim 2, wherein said anchor further comprises:

an anchor projection extending out from said thin projection in a direction generally perpendicular to said thin projection; and a projection extending out from the outer surface wall of said handle and forming a ledge within said inner surface wall of said handle for receiving said anchor projection.

4. The striking implement of claim 2, wherein said anchor further comprises:

an anchor projection extending out from said thin projection in a direction generally perpendicular to said thin projection; and a lip extending from said distal end of said handle, said lip overlapping said anchor projection so as to prevent dislodgment of said proximal tapered end of said barrel component from within said hollow handle component.

5. The striking implement of claim 2 wherein said anchor further comprises:

a tie rod secured to said tapered proximal end of said barrel component and anchored in at least one location to said inner surface wall of said handle component.

6. The striking implement of claim 5, wherein said tie rod passes through said proximal tapered end of said barrel component.

7. The striking implement of claim 2, wherein said tapered proximal end of said barrel component is directly anchored to the inner surface floor of said hollow handle component.

8. The striking implement of claim 1 wherein said striking implement is a ball bat.

9. The ball bat of claim 8 further comprising a handle knob.

10. The ball bat of claim 8 wherein said distal end of said barrel is hollow, further comprising one or more performance enhancing devices in said hollow distal end of said barrel.

* * * * *